US008583018B2

(12) United States Patent
Ando

(10) Patent No.: US 8,583,018 B2
(45) Date of Patent: Nov. 12, 2013

(54) FUSING DEVICE AND IMAGE FORMING APPARATUS USING THE SAME

(75) Inventor: Takashi Ando, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 182 days.

(21) Appl. No.: 13/373,238

(22) Filed: Nov. 9, 2011

(65) Prior Publication Data

US 2012/0155931 A1 Jun. 21, 2012

(30) Foreign Application Priority Data

Dec. 20, 2010 (JP) ..... 2010-283828
May 6, 2011 (KR) ..... 10-2011-0043081

(51) Int. Cl.
*G03G 15/20* (2006.01)

(52) U.S. Cl.
USPC ..... 399/328; 399/122

(58) Field of Classification Search
USPC ..... 399/328, 122
See application file for complete search history.

(56) References Cited

U.S. PATENT DOCUMENTS 8,417,166 B2 * 4/2013 Nakamura ..... 399/313
2004/0156660 A1 * 8/2004 Fuma et al. ..... 399/328
2010/0322667 A1 * 12/2010 Kitagawa ..... 399/122

FOREIGN PATENT DOCUMENTS

JP 61192668 A * 8/1986
JP 6-301309 10/1994
JP 7-20743 1/1995
JP 2004-301058 10/2004
JP 2005-326524 11/2005
JP 2006-163061 6/2006
JP 2009-237188 10/2009
JP 2009-281164 12/2009

* cited by examiner

*Primary Examiner* — David Gray
*Assistant Examiner* — G. M. Hyder
(74) *Attorney, Agent, or Firm* — Staas & Halsey LLP

(57) ABSTRACT

A fusing device includes a fusing roller, a compression roller, and a cam; a first link having an end as a rotation support point, another end with a contact point with the cam, and an intermediate point between the end and another end thereof; a second link having a first end, a second end, and a third end, the first end rotatably connected to the intermediate point of the first link, and the second end configured to rotatably support the compression roller; a third link having an end rotatably supported and another end rotatably connected to the third end of the second link; and an elastic compression member configured to elastically compress the compression roller against the fusing roller via the first link.

10 Claims, 8 Drawing Sheets

FUSING DEVICE AND IMAGE FORMING APPARATUS USING THE SAME

CROSS-REFERENCE TO RELATED APPLICATIONS

This application claims the priority benefit of Japanese Patent Application No. 2010-283828, filed on Dec. 20, 2010, in the Japanese Patent Office and Korean Patent Application No. 10-2011-0043081, filed on May 6, 2011, in the Korean Intellectual Property Office, the disclosures of which are incorporated herein in their entirety by reference

BACKGROUND

1. Field

An embodiment or embodiments relates to a fusing device and an image forming apparatus, and more particularly, to a fusing device and an image forming apparatus using the same by which characteristics of compression/separation (or decompression) of a fusing roller by/from a compression roller may be improved.

2. Description of the Related Art

An image forming apparatus, such as a photocopier, a printer, or a fax, may form a toner image on an image receptor based on image information, transfer the toner image onto a recording material, allow the recording material on which the toner image is received to pass through a fusing device, and fuse the toner image to the recording material through heat and pressure. In general, the fusing device may be a thermal-roller type or a belt (or film) type.

A thermal-roller-type fusing device may include a fusing roller and a compression roller, and the fusing roller may heat itself, as shown in Japanese Patent Publication No. 2005-326524. Meanwhile, a belt-type fusing device may include a fusing roller and a compression roller, and a heated belt may be supplied to the fusing roller, as discussed in Japanese Patent Publication No. 2009-237188. In an ordinary operation state, the compression roller may be compressed against the fusing roller by a compression spring and rotate. Also, when a recording material on which a toner image is received is allowed to pass through the compressed rollers, the toner image may melt due to heat of the fusing roller (or belt) and be fused to the recording material.

However, when the compression roller remains compressed against the fusing roller for a long time in a stop state, the rollers may be deformed or the belt may be damaged. Accordingly, for example, when the stop state is maintained for a long time, when the recording material is jammed, or when the fusing roller is rapidly heated, the compression roller may be separated from the fusing roller against an elastic pressure of a compression spring.

In general, compression/separation of the fusing roller by/from the compression roller may be enabled by a simple lever mechanism using a cam, as shown in Japanese Patent Publication No. 2005-326524 and Japanese Patent Publication No. 2009-237188. The simple lever mechanism may include a compression lever configured to sustain the compression roller, a compression spring configured to elastically compress the compression roller against the fusing roller using the compression lever, and the cam configured to operate the compression lever. In the simple lever mechanism, the compression lever may be moved toward the fusing roller or separated from the fusing roller due to rotation of the cam so that the compression roller may be compressed against or separated from the fusing roller.

However, high speed formation of an image and formation of a high-definition image require a fusing nip having a great width in a conveyance direction of the recording material to ensure a time taken for the fusing roller to fuse the toner image to the recording material. Accordingly, a sufficient distance over which the compression roller is compressed against and separated from the fusing roller should be ensured.

Therefore, a conventional fusing device increases a distance over which a compression roller operates by increasing an operation radius (corresponding to a difference between a maximum radius and a minimum radius) of a cam or increasing a lever ratio. However, a space containing the cam or the compression lever may be increased, thus increasing the size of not only the fusing device but also that of an image forming apparatus.

SUMMARY

Additional aspects and/or advantages will be set forth in part in the description which follows and, in part, will be apparent from the description, or may be learned by practice of the invention.

The present invention provides a fusing device and an image forming apparatus by which characteristics of compression/separation (or decompression) of a fusing roller by/from a compression roller are improved.

According to an aspect of an embodiment or embodiments, there is provided a fusing device including: a fusing roller, a compression roller, a cam; a first link having an end as a rotation support point, another end with a contact point with the cam, and an intermediate point between the end and another end thereof; a second link having a first end, a second end, and a third end, the first end rotatably connected to the intermediate point of the first link, and the second end configured to rotatably support the compression roller; a third link having an end rotatably supported and another end rotatably connected to the third end of the second link; and an elastic compression member configured to elastically compress the compression roller against the fusing roller via the first link.

In the fusing device, the third link controls rotation of the second link such that the second end of the second link moves toward the fusing roller based on a reference line connecting the end of the first link and the intermediate point of the first link when the first link moves toward the fusing roller due to rotation of the cam against an elastic pressure of the elastic compression member, and such that the second end of the second link moves away from the fusing roller based on the reference line when the first link moves away from the fusing roller.

$d2' > d3 \times (L3/L4)$, where $d2'$ is a maximum operation distance of the compression roller, $L3$ is a distance between the rotation support point of the first link and a rotation support point of the compression roller, $L4$ is a distance between the rotation support point of the first link and the contact point with the cam, and $d3$ is an operation radius of the cam.

A reference angle between an auxiliary line extending from the first end of the second link vertical to an operation direction of the compression roller and the second end of the second link disposed on an opposite side of the auxiliary line may range from about 160° to 270° when the compression roller is farthest away from the fusing roller, and an operation distance of the compression roller may gradually increase near the maximum operation distance when the compression roller comes near the fusing roller.

A reference angle between an auxiliary line extending from the first end of the second link vertical to an operation direction of the compression roller and the second end of the second link disposed on an opposite side of the auxiliary line may be 180°−α or 180°+α when the compression roller is farthest away from the fusing roller, and be 180°+α or 180°−α when the compression roller is nearest to the fusing roller.

According to another aspect of an embodiments or embodiments, there is provided an image forming apparatus including the fusing device.

BRIEF DESCRIPTION OF THE DRAWINGS

The above and other features and advantages of the present invention will become more apparent by describing in detail exemplary embodiments thereof with reference to the attached drawings in which:

FIG. 3A is a schematic view showing a configuration and a compression operation of a fusing device having a four-bar link mechanism according to an embodiment of;

DETAILED DESCRIPTION

Figure 1:
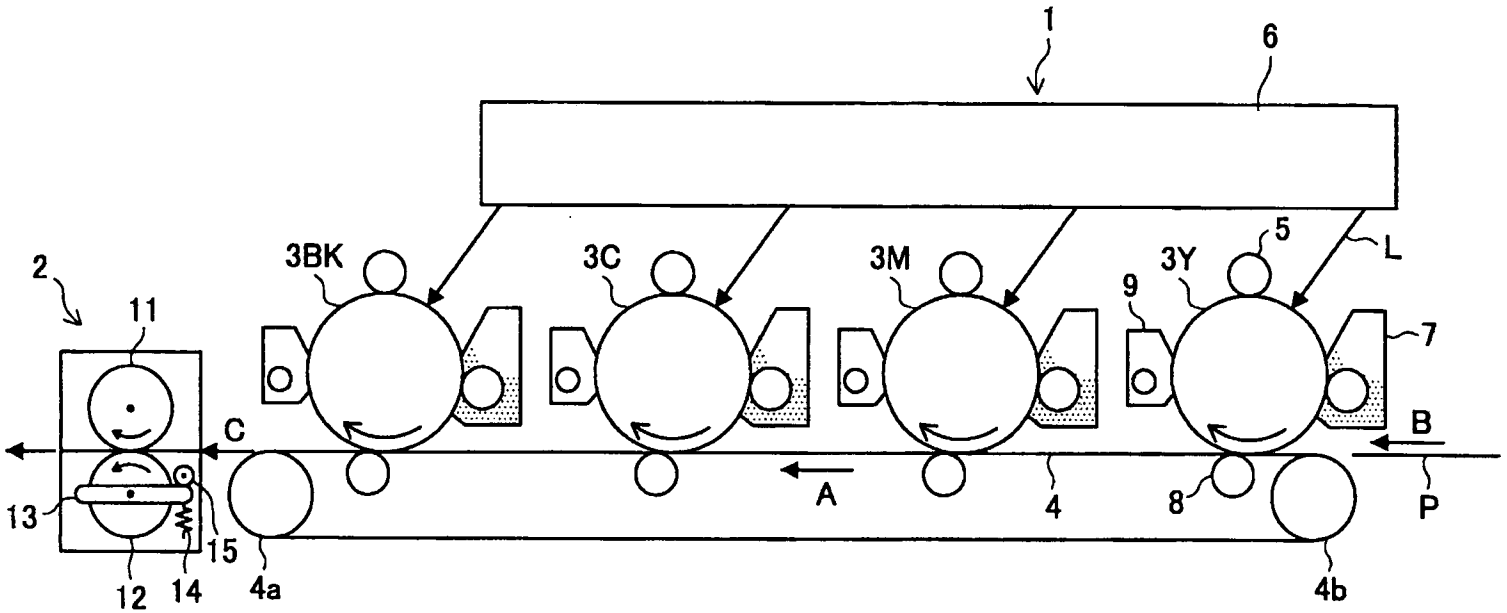
FIG. 1 is a schematic view of a typical color image forming apparatus.

Reference will now be made in detail to the embodiments, examples of which are illustrated in the accompanying drawings, wherein like reference numerals refer to the like elements throughout. The embodiments are described below to explain the present invention by referring to the figures.

An embodiment or embodiments will be described more fully hereinafter with reference to the accompanying drawings, in which embodiments are shown. In the specification and drawings, the same reference numerals are used to denote components having substantially the same functions, thus repeated description thereof will be omitted.

1. CONFIGURATION OF IMAGE FORMING APPARATUS

FIG. 1 is a schematic view of a typical color image forming apparatus. Referring to FIG. 1, the image forming apparatus may include an image forming unit 1 configured to form a superimposed toner image on a recording material P and a fusing device 2 configured to fuse the polymerized toner image to the recording material P.

The image forming unit 1 may include photosensitive drums as first through fourth image receptors 3Y, 3M, 3C, and 3BK, and yellow (Y), magenta (M), cyan (C), and black (BK) toner images may be formed on the image receptors 3Y, 3M, 3C, and 3BK, respectively. A transfer belt 4 may be disposed opposite to the first through fourth image receptors 3Y, 3M, 3C, and 3BK and supported by a drive roller 4*a* and a driven roller 4*b* and run in the direction of an arrow A.

For example, the image receptor 3Y on which the Y toner image is received may rotate clockwise, and a surface of the image receptor 3Y may be uniformly charged with a predetermined polarity by a charging roller 5. Next, an optically modulated laser beam L may be irradiated from a laser write unit 6 to the charged surface. Thus, an electrostatic latent image may be formed on the image receptor 3Y and converted into a visible image by a developing device 7 to form the Y toner image.

Meanwhile, the recording material P may be supplied from a paper supply unit (not shown), sent between the image receptor 3Y and the transfer belt 4 as denoted by an arrow B, received by the transfer belt 4, and conveyed. A transfer roller 8 may be disposed in a position approximately opposite to the image receptor 3Y across the transfer belt 4, and a voltage having a polarity opposite to a charge polarity of the toner image on the image receptor 3Y may be applied to the transfer roller 8. Thus, the toner image formed on the image receptor 3Y may be transferred to the recording material P. Furthermore, toner not transferred to the recording material P and remaining on the image receptor 3Y may be removed by a cleaning device 9.

Similarly, the M, C, and BK toner images may be respectively formed on the second through fourth image receptors 3M, 3C, and 3BK and sequentially transferred and superimposed onto the recording material P on which the Y toner image is transferred. Thus, by superimposing the four-color toner images on the recording material P, a superimposed image is formed on the recording material P.

The recording material P on which the superimposed toner image is received may be transmitted to the fusing device 2 as denoted by an arrow C. In the fusing device 2, a compression roller 12 may be compressed against a fusing roller 11 by a compression spring 14 and rotated. Also, while the recording material P on which the superimposed toner image is received is passed between the compressed rollers 11 and 12, the superimposed toner image may melt due to heat of the fusing roller 11 and be fused to the recording material P. Afterwards, after being passed through the fusing device 2, the recording material P may be discharged to a paper discharge tray (not shown).

2. FUSING DEVICE 10 HAVING SIMPLE LEVER MECHANISM

Figure 2A:
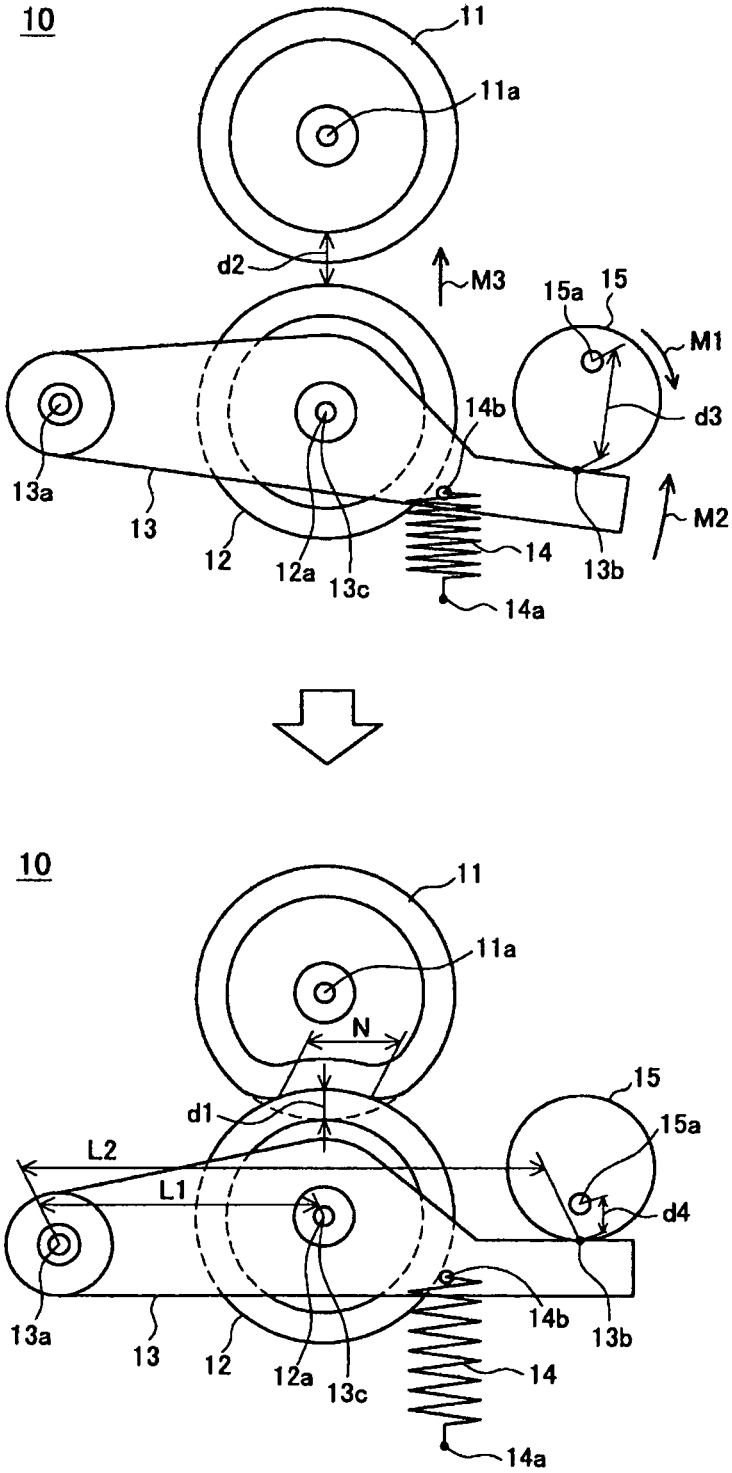
FIG. 2A is a schematic view showing a configuration and a compression operation of a typical fusing device having a simple lever mechanism.
Figure 2B:
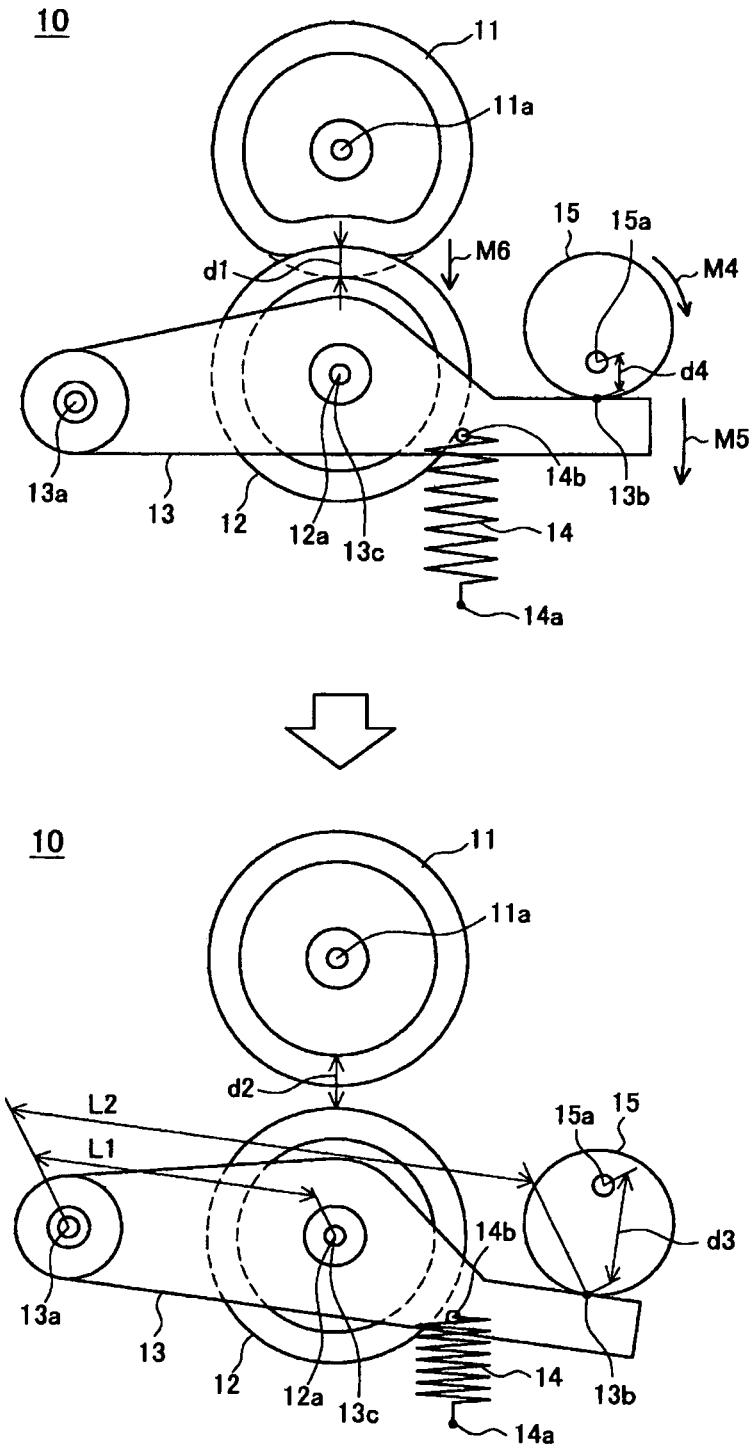
FIG. 2B is a schematic view showing a configuration and a separation operation of the typical fusing device having the simple lever mechanism.

FIGS. 2A and 2B are schematic views showing a configuration and operations of a typical fusing device 10 having a simple lever mechanism. FIG. 2A shows a transition from a separation state to a compression state, while FIG. 2B shows a transition from the compression state to the separation state. Furthermore, the separation state denotes separation of a compression roller 12 from a fusing roller 11, and the compression state denotes compression of the fusing roller 11 by the compression roller 12.

As shown in FIGS. 2A and 2B, the fusing device 10 may include the fusing roller 11, the compression roller 12, a compression lever 13, a compression spring 14, and a cam 15. The fusing roller 11 may be rotatably supported by a frame (not shown) of an image forming apparatus via a rotation support point 11*a*. The compression roller 12 may be rotatably connected to the compression lever 13 via a rotation support point 12*a*. The compression lever 13, which is a member having an approximately rod shape, may have one end (or a rotation support point) 13*a* rotatably supported by the frame, another end having a contact point 13*b* with the cam 15, and an intermediate point 13*c* configured to rotatably support the compression roller 12 via the rotation support point 12*a*. The compression spring 14 may have one end 14*a* fixed to the frame and another end 14*b* fixed to the compression lever 13. The cam 15 may be rotatably supported by the frame via the cam axis 15*a* to contact the contact point 13*b* of the other end of the compression lever 13 and rotatably driven by a motor (not shown).

Here, a distance between the rotation support point 13*a* of the compression lever 13 and the intermediate point 13*c* of the compression lever 13 may be defined as L1, and a distance between the rotation support point 13*a* of the compression lever 13 and the contact point 13*b* of the compression lever 13 may be defined as L2. Also, a maximum radius of the cam 15 with respect to the cam axis 15*a* may be defined as d3, while a minimum radius of the cam 15 with respect to the cam axis 15*a* may be defined as d4.

FIG. 2A shows the transition from the separation state to the compression state. In the compression state, the compression lever 13 may be elastically pressed against by the compression spring 14 toward the fusing roller 11. The cam 15 may be in contact with the compression lever 13 while the cam axis 15*a* is separated from the contact point 13*b* by the minimum radius d4. In the transition from the separation state to the compression state, the compression lever 13 may rotate counterclockwise (refer to M2) based on the rotation support point 13*a* from the separation state with rotation (refer to M1) of the cam 15 and compress the compression roller 12 against the fusing roller 11 (refer to M3). Thus, the compression roller 12 may compress a surface of the fusing roller 11 by a compression distance d1 in a direction from the rotation support point 12*a* of the compression roller 12 to the rotation support point 11*a* of the fusing roller 11. The compression distance d1 may be about (d3−d4)×(L1/L2).

FIG. 2B shows the transition from the compression state to the separation state. In the separation state, the cam 15 may be in contact with the compression lever 13 while the cam axis 15*a* is separated from the contact point 13*b* by the maximum radius d3. In the transition from the compression state to the separation state, the compression lever 13 may rotate away from the fusing roller 11, against the compression spring 14. The compression lever 13 may rotate (refer to M5) clockwise based on the rotation support point 13*a* from the above-described compression state with rotation (refer to M4) of the cam 15 and separate the compression roller 12 from the fusing roller 11 (refer to M6). Thus, the compression roller 12 may be spaced a separation distance d2 (d1≤d2) apart from the surface of the fusing roller 11, which is compressed by the compression distance d1 in the compressed state. The separation distance d2 may be about (d3−d4)×(L1/L2). Furthermore, when the compression distance d1 is equal to the separation distance d2, the compression roller 12 may contact the fusing roller 11 without compressing the surface of the fusing roller 11.

Here, to realize a fusing nip N having a relatively great width in a conveyance direction of a recording material P, the compression distance d1 and the separation distance d2 should be sufficiently ensured. In other words, a sufficient maximum operation distance (corresponding to the separation distance d2) of the compression roller 12 should be ensured. To this end, an operation radius (corresponding to a difference (d3−d4) between the maximum radius d3 and the minimum radius d4 of the cam 15) of the cam 15 or a lever ratio (L1/L2) of the compression lever 13 may be increased. Thus, an operation occupancy range of the cam 15 or a distance between the rotation support point 13*a* of the compression lever 13 and the rotation support point 12*a* of the compression roller 12 may be increased. Accordingly, not only the fusing device 10 but also the image forming apparatus may be relatively large-sized.

3. FUSING DEVICE HAVING FOUR-BAR LINK MECHANISM

Figure 3A:
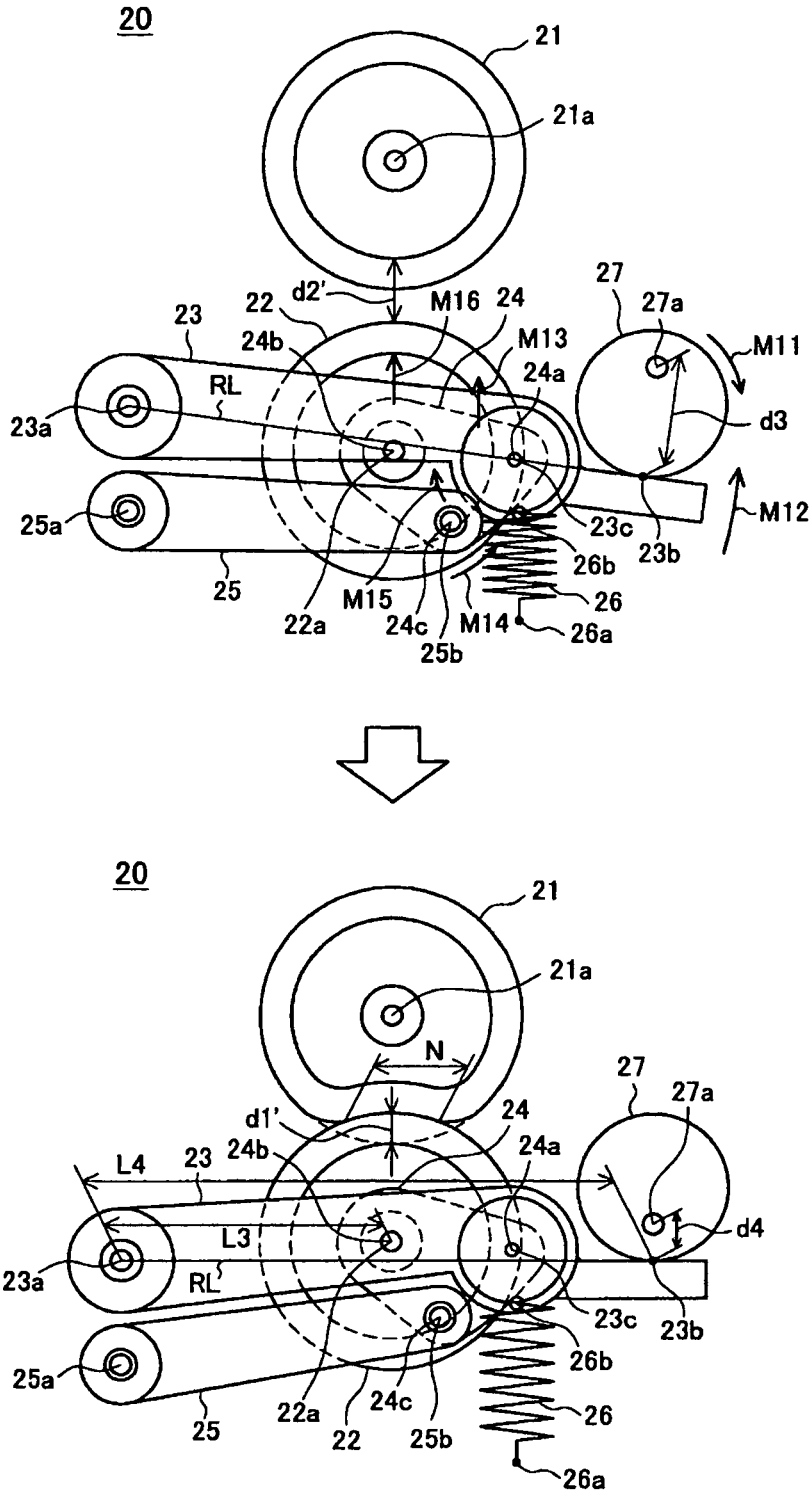
Figure 3B:
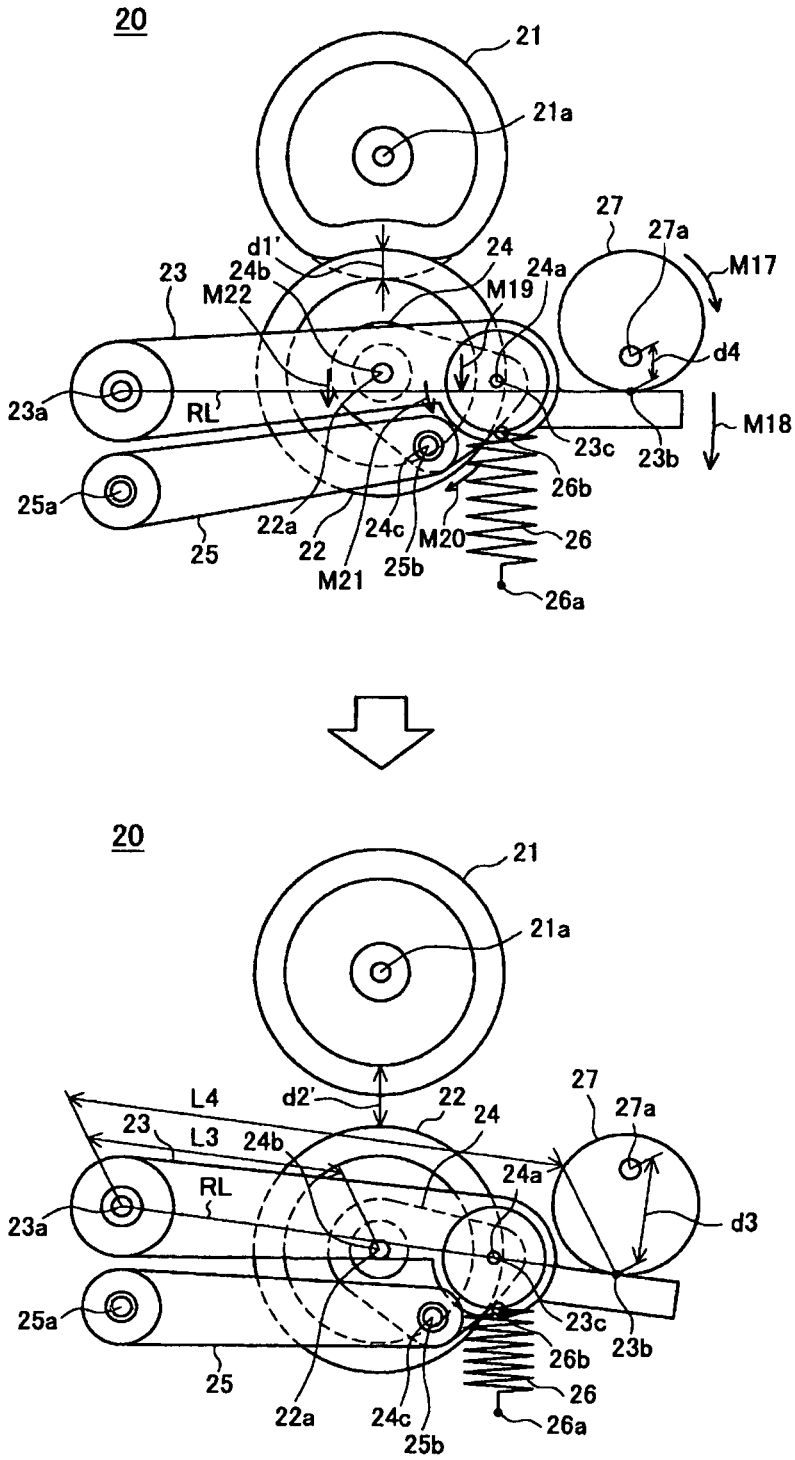
FIG. 3B is a schematic view showing a configuration and a separation operation of the fusing device having the four-bar link mechanism according to an embodiment.

FIGS. 3A and 3B are construction diagrams of a fusing device 20 having a four-bar link mechanism according to an embodiment. FIG. 3A shows a transition from a separation state to a compression state, and FIG. 3B shows a transition from the compression state to the separation state.

As shown in FIGS. 3A and 3B, the fusing device 20 may include a fuse roller 21, a compression roller 22, a first link 23, a second link 24, a third link 25, a fourth link (not shown), a compression spring 26 functioning as an elastic compression member, and a cam 27. The fuse roller 21 may be rotatably supported by a frame (not shown) of an image forming apparatus. The compression roller 22 may be rotatably connected to the first link 23. The first link 23, which is a member having an approximately rod shape, may have one end (or a rotation support point) 23*a* rotatably supported by the frame, another end having a contact point 23*b* of contact with the cam 27, and an intermediate point 23*c* between the rotation support point 23*a* and the contact point 23*b*. The second link 24, which is a member having an approximately triangular shape, may have first through third ends 24*a*, 24*b*, and 24*c* corresponding to respective vertices of the triangular shape. The first end 24*a* of the second link 24 may be rotatably connected to the intermediate point 23*c* of the first link 23, and the second end 24*b* of the second link 24 may rotatably support the compression roller 22. The third link 25, which is a member having an approximately rod shape, may have one end (or a rotation support point) 25*a* rotatably supported and another end 25*b* rotatably connected to the third end 24*c* of the second link 24. The fourth link (not shown) is a frame on which the ends 23*a* and 25*a* of the first and third links 23 and 25 pivotably connected to and acts as the fourth link. The compression spring 26 may have one end 26*a* fixed to the frame and another end 26*b* fixed to the first link 23. The cam 27 may be rotatably supported by the frame to contact the contact point 23*b* of the other end of the first link 23 and rotated by a motor (not shown).

In the fusing device 20 shown in FIGS. 3A and 3B, the rotation support point 23*a* of the first link 23 and the rotation support point 25*a* of the third link 25 may be disposed along a line approximately parallel to a direction in which a roller axis 21*a* of the fusing roller 21 is connected to the roller axis 22*a* of the compression roller 22. Also, the second link 24 may be disposed such that a distance between the first end 24*a* of the second link 24 and the rotation support point 23*a* of the first link 23 is greatest, a distance between the third end 24*c* of the second link 24 and the rotation support point 23*a* of the first link 23 is intermediate between the distance between the first end 24*a* of the second link 24 and the rotation support point 23*a* of the first link 23, and a distance between the second end 24*b* of the second link 24 and the rotation support point 23*a* of the first link 23 is smallest, among the distances between the rotation support point 23*a* and the first through third ends 24*a*, 24*b*, and 24*c* of the second link 24.

Here, the distance between the rotation support point 23*a* of the first link 23 and the second end 24*b* of the second link 24 (or the roller axis 22*a* of the compression roller 22) may be defined as L3, a distance between the rotation support point 23*a* of the first link 23 and the contact point 23*b* may be defined as L4. Also, a maximum radius of the cam 27 with respect to a cam axis 27*a* may be defined as d3, and a minimum radius of the cam 27 with respect to the cam axis 27*a* may be defined as d4.

FIG. 3A shows the transition from the separation state to the compression state. In the compression state, the first link 23 may be elastically pressed against by the compression spring 26 toward the fusing roller 21. The cam 27 may be in contact with the first link 23 while the cam axis 27*a* is separated from the contact point 23*b* by the minimum radius d4. The second link 24 may compress the compression roller 22 against the fusing roller 21 with rotation of the second link 24 controlled by the third link 23.

During the transition from the separation state to the compression state, the four-bar link mechanism may operate as follows. The cam 27 may rotate (refer to M11) and make the transition from a state where the cam 27 contacts the first link 23 while the cam axis 27*a* is separated from the contact point 23*b* by the maximum distance d3 to a state where the cam 27 contacts the first link 23 while the cam axis 27*a* is separated from the contact point 23*b* by the minimum radius d4. The first link 23 may rotate counterclockwise (refer to M12) based on the rotation support point 23*a* with rotation of the cam 27. The first end 24*a* of the second link 24 may be connected to the intermediate point 23*c* of the first link 23 so that the second link 24 may be moved toward the fusing roller 21 (refer to M13) with rotation of the first link 23. The other end 25*b* of the third link 25 may be connected to the third end 24*c* of the second link 24 so that the third link 25 may be rotated counterclockwise (refer to M14) based on the rotation support point 25*a* with motion of the second link 24. The third end 24*c* of the second link 24 may be connected to the other end 25*b* of the third link 25 so that the second link 24 may be rotated clockwise based on the first end 24*a* with rotation of the third link 25.

That is, while being interlocked with the rotation of the first link 23 and moved toward the fuse roller 21 (refer to M13), the second link 24 may be interlocked with the rotation of the third link 25 and rotate clockwise based on the first end 24*a* (refer to M15). Thus, the second end 24*b* of the second link 24 may move toward the fusing roller 21 based on a reference line RL connecting the rotation support point 23*a* of the first link 23 and the intermediate point 23*c* of the first link 23, that is, the second end 24*b* of the second link 24 may move and protrude toward the fusing roller 21, so that the compression roller 22 may be compressed against the fusing roller 21 (refer to M16). As a result, the compression roller 22 may compress a surface of the fusing roller 21 by a compression distance d1' toward the roller axis 21*a* of the fusing roller 21.

FIG. 3B shows the transition from the compression state to the separation state. In the separation state, the cam 27 may be in contact with the first link 23 while the cam axis 27*a* is separated from the contact point 23*b* by the maximum distance d3. The first link 23 may rotate away from the fusing roller 21, against the compression spring 26. The second link 24 may separate the compression roller 22 from the fusing roller 21 with rotation of the second link 24 controlled by the third link 25.

During the transition from the compression state to the separation state, the four-bar link mechanism may operate as follows. The cam 27 may rotate (refer to M17) and make the transition from the state where the cam 27 contacts the first link 23 while the cam axis 27*a* is separated from the contact point 23*b* by the minimum distance d4 to the state where the cam 27 contacts the first link 23 while the cam axis 27*a* is separated from the contact point 23*b* by the maximum distance d3. The first link 23 may rotate clockwise (refer to M18) based on the rotation support point 23*a* with the rotation of the cam 27. The first end 24*a* of the second link 24 may be connected to the intermediate point 23*c* of the first link 23 so that the second link 24 may be moved away from the fusing roller 21 with the rotation of the first link 23. The other end 25*b* of the third link 25 may be connected to the third end 24*c* of the second link 24 so that the third link 25 may be rotated clockwise (refer to M20) based on the rotation support point 25*a* with the motion of the second link 24. The third end 24*c* of the second link 24 may be bonded to the other end 25*b* of the third link 25 so that the second link 24 may be rotated counterclockwise (refer to M21) based on the first end 24*a* with the rotation of the third link 25.

That is, while being interlocked with the rotation of the first link 23 and moved away from the fusing roller 21 (refer to M19), the second link 24 may be interlocked with the rotation of the third link 25 and rotate counterclockwise (refer to M21) based on the first end 24*a*. Thus, the second end 24*b* of the second link 24 may move away from the fusing roller 21 based on the reference line RL connecting the rotation support point 23*a* of the first link 23 and the intermediate point 23*c*, that is, the second end 24*b* of the second link 24 may move and protrude away from the fusing roller 21, so that the compression roller 22 may be separated from the fusing roller 21. As a result, the compression roller 22 may be separated from the surface of the fusing roller 21 by a separation distance d2'. The separation distance d2' is greater than d3×(L3/L4), where d2' is a maximum operation distance of the compression roller, L3 is a distance between the rotation support point of the first link and a rotation support point of the compression roller, L4 is a distance between the rotation support point of the first link and the contact point with the cam, and d3 is an operation radius of the cam.

Figure 4:
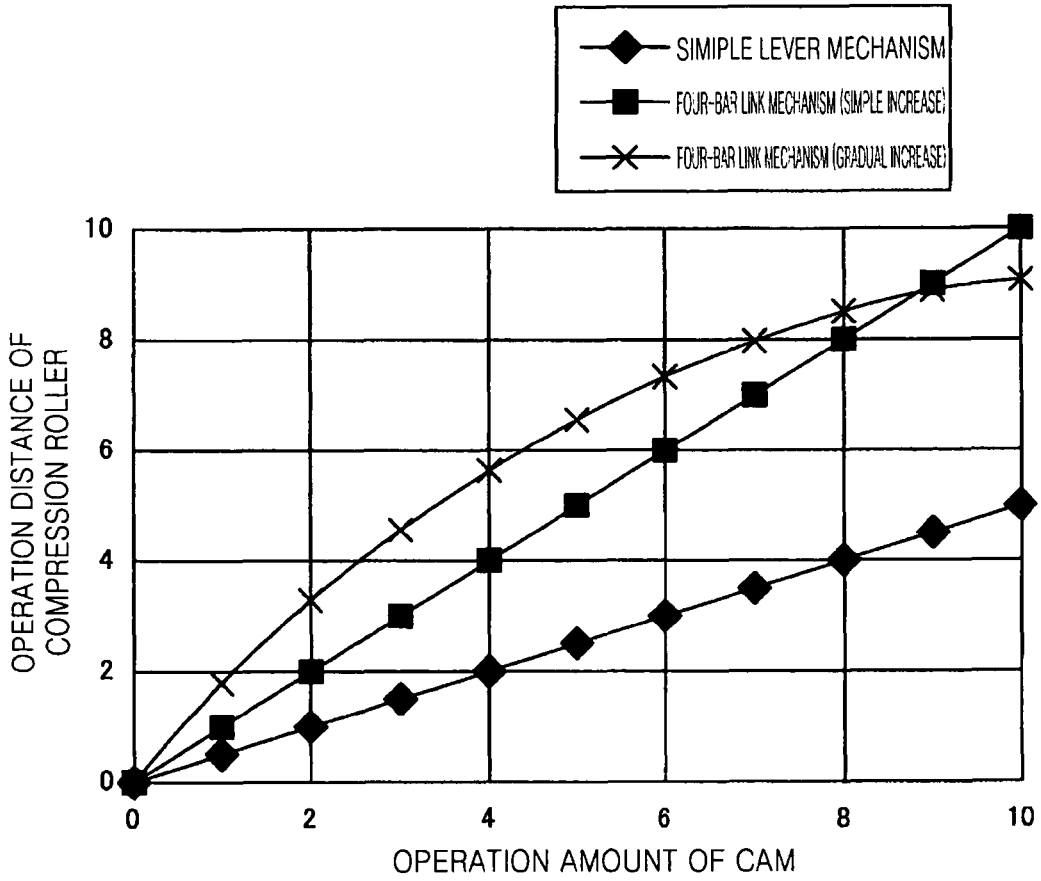
FIG. 4 is a graph showing an increasing tendency of an operation distance of a compression roller.

FIG. 4 is a diagram showing an increasing tendency of an operation distance of the compression roller 22. In FIG. 4, an abscissa denotes a variation in operation amount of the cam 27, and an ordinate denotes a variation in the operation distance of the compression roller 22.

Here, the operation amount of the cam 27 is a function of a distance between the cam axis 27*a* of the cam 27 and the contact point 23*b* of the first link 23. The operation amount of the cam 27 may be 0 in the separation state where the maximum radius of the cam 27 is d3, and reach a maximum value in the compression state where the minimum radius of the cam 27 is d4. Similarly, the operation distance of the compression roller 22 may be a function of a distance between the roller axis 21*a* of the fuse roller 21 and the roller axis 22*a* of the compression roller 22. The operation distance of the compression roller 22 may be 0 in the separation state and reach a maximum value in the compression state.

FIG. 4 is a graph showing a comparison in between an operation distance of the compression roller 12 of the simple lever mechanism and the operation distance of the compression roller 22 of the four-bar link mechanism. In both the simple lever mechanism and the four-bar link mechanism, the lever ratio of the compression lever 13 may be about equal to that of the first link 23 (L1/L2≈L3/L4≈0.5), the cam 15 may have the same maximum and minimum radii d3 and d4 as the cam 27.

In the simple lever mechanism, the operation distance of the compression roller 12 may be about 0.5 times an operation amount of the cam 15. By comparison, in the four-bar link mechanism, the operation distance of the compression roller 22 may be about the operation amount of the cam 27, that is, twice the operation distance of the compression roller 12 of the simple lever mechanism. Accordingly, even if an operation radius of a cam or a lever ratio is not increased, a maximum operation distance of the compression roller 22 may be increased more than a maximum operation distance (d3×L3/L4=0.5×d3) obtained using the lever ratio. Also, the operation distance of the compression roller 22 may be approximately linearly proportional to the operation amount of the cam 27.

Furthermore, the above-described operation distance of the compression roller 22 of the four-bar link mechanism may become more than the operation amount of the cam 27 by changing, for example, the arrangement or shape of the link mechanism or the cam 27. Accordingly, there may be a greater degree of freedom in designing the fusing device 2.

Referring to FIG. 4, the operation distance of the compression roller 22 tends to increase approximately linearly initially and then gradually increase near the maximum operation distance of the compression roller 22. Fusing conditions (e.g., a compression distance) may vary due to mechanical errors of the fusing device 2. To minimize variations in the fusing conditions near the maximum operation distance of the compression roller 22, the fusing device 2 may sometimes need to gradually increase the operation distance of the compression roller 22 near the maximum operation distance of the compression roller 22. By gradually increasing the operation distance of the compression roller 22 near the maximum operation distance of the compression roller 22, influence of the variations in the fusing conditions on the operation distance of the compression roller 22 may be relatively suppressed.

In addition, the fusing device 2 may need to maximize the operation distance of the compression roller 22. By maximizing the operation distance of the compression roller 22, a sufficient fusing nip N may be ensured, and the fusing device 2 and the image forming apparatus may be downscaled.

Figure 5:
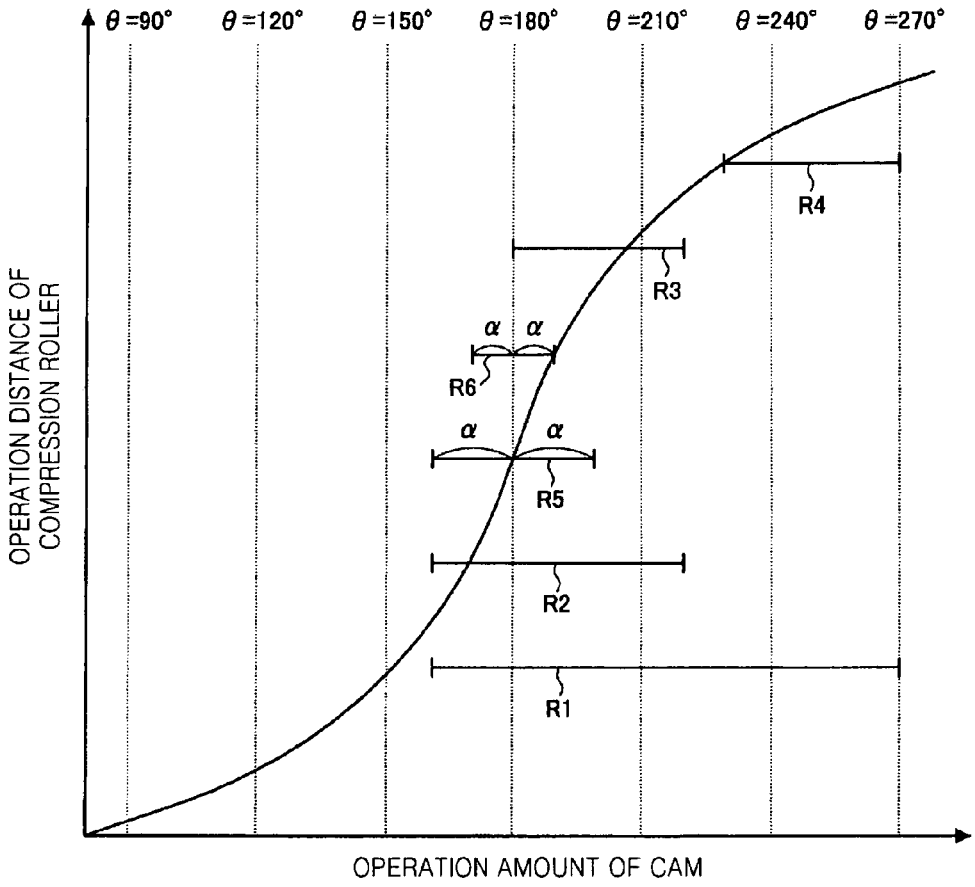
FIG. 5 is a graph for explaining a variation in an increasing tendency of an operation distance of a compression roller according to arrangement of a link mechanism.

FIG. 5 is a graph for explaining a variation in an increasing tendency of the operation distance of the compression roller 22 according to an arrangement of a link mechanism. In FIG. 5, an abscissa denotes the operation amount of the cam 27, and an ordinate denotes the operation distance of the compression roller 22. FIG. 5 is also a schematic view of a motion track of the second end 24*b* of the second link 24 (i.e., the roller axis 22*a* of the compression roller 22).

Figure 6:
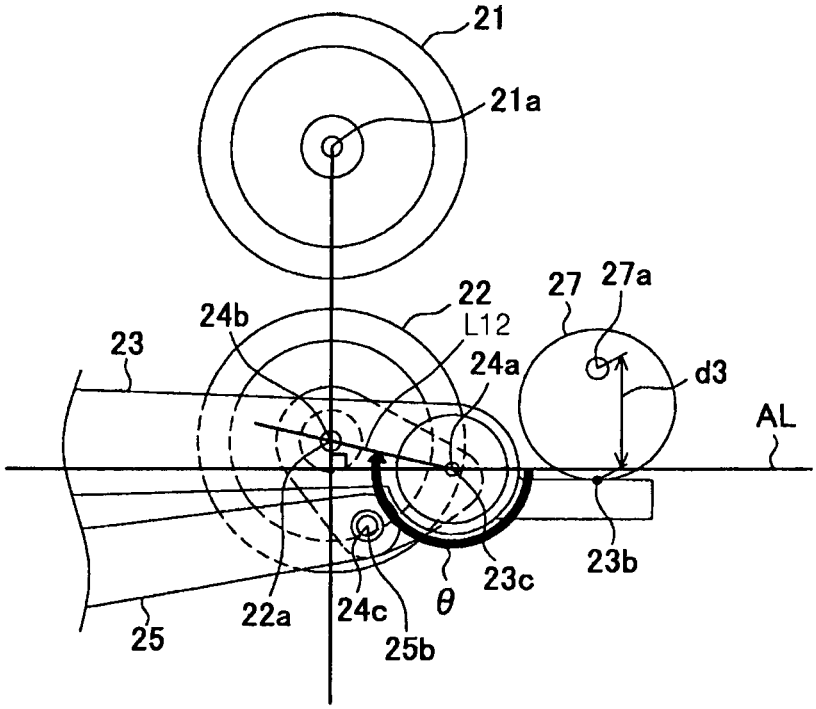
FIG. 6 is a diagram for explaining the definition of a reference angle.

In connection with FIG. 5, FIG. 6 shows that an angle Θ between an auxiliary line AL and the second end 24*b* of the second link 24 based on the first end 24*a* of the second link 24 is defined as a reference angle Θ. That is, the reference angle Θ refers to an angle formed by the auxiliary line AL with a line L12 connecting the first and second ends 24*a* and 24*b* of the second link 24, based on the first end 24*a* of the second link 24. Here, the auxiliary line AL is defined as a line that extends from the first end 24*a* perpendicularly to an operation direction of the compression roller 22 (or a direction in which the roller axis 21*a* of the fusing roller 21 is connected to the roller axis 22*a* of the compression roller 22). The reference angle Θ may be changed between the separation state of the compression roller 22 and the compression state of the compression roller 22. For example, in the embodiment of FIGS. 3A and 3B, the reference angle Θ may increase during the transition from the separation state to the compression state. A variation range of the reference angle Θ may depend on the arrangement of the link mechanism.

Here, the second link 24 may rotate with rotation of the cam 27 while the rotation of the second link 24 is controlled by the third link 25, and the second end 24*b* of the second link 24 may move with the rotation of the second link 24. Also, a distance by which the second end 24*b* moves in the operation direction of the compression roller 22 may increase toward the reference angle Θ of 180° and reduce away from the reference angle Θ of 180° with respect to the operation amount of the cam 27.

That is, as shown in FIG. 5, the increasing tendency (or a slope) of the operation distance of the compression roller 22 may increase toward the reference angle Θ of 180° and decrease away from the reference angle Θ of 180°. More specifically, the operation distance of the compression roller 22 may convexly increase with an increase in the operation amount of the cam 27 within the range of the reference angle Θ of 180° or higher and concavely increase with the increase in the operation amount of the cam 27 within the range of the reference angle Θ of lower than 180°.

Accordingly, in order to gradually increase the operation distance of the compression roller 22 near the maximum operation distance, it may be only necessary to vary the reference angle Θ within a range in which the increasing tendency of the operation distance gradually decreases near the maximum operation distance, for example, within a range R1 of about 160° to about 270°. For instance, when the reference angle Θ is varied within a range R2 of about 160° to 220°, the increasing tendency of the operation distance may increase within a range of about 160° to 200° and become relatively lower within a range of about 200° to 220°. The reference angle Θ may be varied not only within the above-described range but also within another range, for example, within a range R3 of about 180° to 220° or within a range R4 of about 230° to 270°. Even if the reference angle Θ is varied within any range, the operation distance of the compression roller 22 may gradually increase near the maximum operation distance.

In addition, to maximize the operation distance of the compression roller 22, it may be only necessary to vary the reference angle Θ within a range in which the increasing tendency of the operation distance is maximized, that is, within a range of 180°−α to 180°+α. For example, when the reference angle Θ is varied within a range R5 of about 160° to about 200°) (α=20°, the increasing tendency of the operation distance may be increased within both a range of about 160° to 180° and a range of about 180° to about 200°, thereby maximizing the total operation distance. In another example, the reference angle Θ may be varied within a range R6 of about 170° to 190°) (α=10°. Even if the reference angle Θ is varied within any range, the operation distance of the compression roller 22 may be maximized.

Furthermore, as shown in FIG. 4, to increase the operation distance of the compression roller 22 approximately linearly, the reference angle Θ may be varied within a range in which the increasing tendency of the operation distance is approximately linear, that is, within a narrow range near about 180°.

4. CONCLUSION

According to the fusing device 2 and the image forming apparatus according to embodiments as described above, characteristics of compression/separation (or decompression) of the fusing roller 21 by/from the compression roller 22 may be improved using the four-bar link mechanism. Due to the improved compression/separation characteristics, the maximum operation distance of the compression roller 22 may be increased or the operation distance of the compression roller 22 may be gradually increased near the maximum operation distance or maximized.

An embodiment or Embodiments provide a fusing device and an image forming apparatus using the same by which characteristics of compression/separation (or decompression) of a fusing roller by/from a compression roller.

While it has been particularly shown and described with reference to embodiments thereof, it will be understood by those of ordinary skill in the art that various changes in form and details may be made therein without departing from the spirit and scope of an embodiment or embodiments as defined by the following claims.

For example, although it is described above that the cam 27 is rotated by a motor, the cam 27 may be rotated manually. Also, although it is described above that the compression roller 22 is elastically compressed by the compression spring 26, the compression roller 22 may be elastically compressed by an elastic compression unit (or elastic unit) other than the compression spring 26. Furthermore, although the embodiments describe only a color image forming apparatus, an embodiment or embodiments may be applied likewise to a single-color image forming apparatus.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A fusing device comprising:

a fusing roller;

a compression roller;

a cam;

a first link having an end as a rotation support point, another end with a contact point with the cam, and an intermediate point between the end and another end thereof;

a second link having a first end, a second end, and a third end, the first end rotatably connected to the intermediate point of the first link, and the second end configured to rotatably support the compression roller;

a third link having an end rotatably supported and another end rotatably connected to the third end of the second link; and an elastic compression member configured to elastically compress the compression roller against the fusing roller via the first link, wherein the third link controls rotation of the second link such that the second end of the second link moves toward the fusing roller based on a reference line connecting the end of the first link and the intermediate point of the first link when the first link moves toward the fusing roller due to rotation of the cam against an elastic pressure of the elastic compression member, and wherein the third link controls rotation of the second link such that the second end of the second link moves away from the fusing roller based on the reference line when the first link moves away from the fusing roller.

2. The device of claim 1, wherein $d2' > d3 \times (L3/L4)$, where d2' is a maximum operation distance of the compression roller, L3 is a distance between the rotation support point of the first link and a rotation support point of the compression roller, L4 is a distance between the rotation support point of the first link and the contact point with the cam, and d3 is an operation radius of the cam.

3. The device of claim 1, wherein a reference angle between an auxiliary line extending from the first end of the second link perpendicularly to an operation direction of the compression roller and the second end of the second link disposed on an opposite side of the auxiliary line ranges from about 160° to 270° when the compression roller is farthest away from the fusing roller, and an operation distance of the compression roller gradually increases near a maximum operation distance when the compression roller is near the fusing roller.

4. The device of claim 1, wherein a reference angle between an auxiliary line extending from the first end of the second link perpendicularly to an operation direction of the compression roller and the second end of the second link disposed on an opposite side of the auxiliary line is $180°-\alpha$ or $180°+\alpha$ when the compression roller is farthest away from the fusing roller, and is $180°+\alpha$ or $180°-\alpha$ when the compression roller is nearest to the fusing roller.

5. The device of claim 1, wherein the second link has a triangular shape.

6. An image forming apparatus comprising the fusing device of claim 1.

7. The image forming apparatus of claim 6, wherein $d2' > d3 \times (L3/L4)$, where d2' is a maximum operation distance of the compression roller, L3 is a distance between the rotation support point of the first link and a rotation support point of the compression roller, L4 is a distance between the rotation support point of the first link and the contact point with the cam, and d3 is an operation radius of the cam.

8. The image forming apparatus of claim 6, wherein a reference angle between an auxiliary line extending from the first end of the second link perpendicularly to an operation direction of the compression roller and the second end of the second link disposed on an opposite side of the auxiliary line ranges from about 160° to 270° when the compression roller is farthest away from the fusing roller, and an operation distance of the compression roller gradually increases near a maximum operation distance when the compression roller is near the fusing roller.

9. The image forming apparatus of claim 6, wherein a reference angle between an auxiliary line extending from the first end of the second link perpendicularly to an operation direction of the compression roller and the second end of the second link disposed on an opposite side of the auxiliary line is $180°-\alpha$ or $180°+\alpha$ when the compression roller is farthest away from the fusing roller, and is $180°+\alpha$ or $180°-\alpha$ when the compression roller is nearest to the fusing roller.

10. The image forming apparatus of claim 6, wherein the second link has a triangular shape.

* * * * *